US005373907A

United States Patent [19]

Weaver

[11] Patent Number: 5,373,907

[45] Date of Patent: Dec. 20, 1994

[54] METHOD AND APPARATUS FOR MANUFACTURING AND INSPECTING THE QUALITY OF A MATRIX BODY DRILL BIT

[75] Inventor: Gary E. Weaver, Conroe, Tex.

[73] Assignee: Dresser Industries, Inc., Dallas, Tex.

[21] Appl. No.: 9,215

[22] Filed: Jan. 26, 1993

[51] Int. Cl.[5] ..... E21B 10/62

[52] U.S. Cl. ..... 175/426; 175/428; 76/108.2

[58] Field of Search ..... 175/434, 435, 426, 428; 76/108.2, 108.1, 108.4, 107.1

[56] References Cited

U.S. PATENT DOCUMENTS

| | | | |
|---|---|---|---|
| 3,757,878 | 9/1973 | Wilder et al. | 175/329 |
| 4,234,048 | 11/1980 | Rowley | 175/430 |
| 4,397,361 | 8/1983 | Langford, Jr. | 175/329 |
| 4,423,646 | 1/1984 | Bernhardt | 76/108 R |
| 4,475,606 | 10/1984 | Crow | 175/410 |
| 4,499,795 | 2/1985 | Radtke | 76/108 A |
| 4,667,756 | 5/1987 | King et al. | 175/409 |
| 4,669,522 | 6/1987 | Griffin | 164/97 |
| 4,694,919 | 9/1987 | Barr | 76/108.2 X |
| 4,720,371 | 1/1988 | Shirley | 419/10 |
| 4,753,305 | 6/1988 | Fisher | 175/410 |
| 4,884,477 | 12/1989 | Smith et al. | 76/108 A |
| 4,889,017 | 12/1989 | Fuller et al. | 76/108.2 |
| 4,919,013 | 4/1990 | Smith et al. | 76/108.2 |
| 4,949,598 | 8/1990 | Griffin | 76/108.2 |
| 5,000,273 | 3/1991 | Horton et al. | 76/108.2 X |
| 5,007,493 | 4/1991 | Coolidge et al. | 175/329 |
| 5,033,560 | 7/1991 | Sawyer et al. | 175/410 |

OTHER PUBLICATIONS

Security Strat-X Bits, Security Division, Dresser Industries, Inc. (Date Unknown).

Chapter 6, Manufacturing and Quality Control, Security Division, Dresser Industries, Inc. (Date Unknown).

*Primary Examiner*—Terry Lee Melius

*Attorney, Agent, or Firm*—L. Dan Tucker

[57] ABSTRACT

Quality of a matrix body of a matrix body drill bit is tested by forming an extension of the matrix material near the nose of the matrix body drill bit. A notch is formed in a mold used to form the matrix body drill bit. The notch is filled with matrix powder during loading of the mold and subsequently infiltrated with binder alloy during infiltration of the matrix body. A matrix body extension is thus formed in the notch. The notch, and thus the matrix body extension, has a ratio of length versus diameter sufficiently high to allow the extension to be removed without permanently damaging the matrix body. The removed extension may then be subsequently tested.

18 Claims, 1 Drawing Sheet

METHOD AND APPARATUS FOR MANUFACTURING AND INSPECTING THE QUALITY OF A MATRIX BODY DRILL BIT

FIELD OF THE INVENTION

The invention relates generally to matrix body drill bits, and more particularly to methods of manufacturing and inspecting the quality of matrix body drill bits.

BACKGROUND OF THE INVENTION

Rotary drill bits for boring or drilling holes through the earth by cutting and abrading are well known in the oil and gas industry. Generally, the drill bits fall into one of two categories: drag or fixed cutter bits, including "diamond" bits and roller cone bits. So that the drill bits are better able to withstand the stress induced by the abrasion and the temperatures of boring, faces of rotary drill bits are sometimes superhardened.

Various "hardfacing" techniques for drill bits are well known. Very often, hardfacing involves a technique of molding or bonding a "matrix" material to steel blank or mandrel to form the face of the bit. Rotary drill bits having hard faces formed in this manner are generally referred to as matrix body bits, as opposed to steel bodied bits. In the case of a "fixed cutter" type rotary drill bit (those having no moving parts), natural and synthetic diamond faced "cutters" are attached or molded into recesses or pockets preformed in the face of the matrix body. Tungsten carbide inserts are sometimes used instead of diamonds. Numerous examples of matrix body fixed cutter bits are shown in various U.S. patents, including U.S. Pat. Nos. 5,007,493, and 5,033,560.

The matrix material is generally a sintered refractory metal which is formed in a mold by a powdered metallurgical process called infiltration. The desired features of the bit, such as its profile, cutter pockets and drilling fluid flow passages, are provided for by shaping of the mold and by positioning temporary displacement material within the interior of the mold. The mold is then loaded, first by inserting a steel mandrel into the interior of the mold. The steel blank acts as a core to support the matrix body for attaching to a shank that in turn is used to connect the bit to a drill string. A "porous skeleton" of matrix particles in powdered form is then added around the steel blank. The matrix powder has a relatively high melting temperature. An infiltrating alloy having a relatively lower melting temperature is also placed in the mold. The mold is heated in a furnace to a temperature sufficient to melt the binding alloy. The binding alloy penetrates and fills the porous skeleton of matrix powder. The mold is then cooled under controlled conditions. Upon solidifying, the binding alloy cements together the matrix powder particles into a coherent integral mass securely bonded to the steel blank. The matrix powder is, in most current processes, composed predominately of tungsten carbide powder, and the binder alloy is usually composed of copper and nickel. Other wear-resistant materials used to form a "matrix" body exist and others are constantly being developed.

Forming a coherent matrix of high quality is critical to a matrix body drill bit's strength and durability. Many factors affect the strength and durability of the finished matrix material: the size and packing density of the tungsten carbide powders, the composition and amount of binders and of flux, and the time and temperature relations involved in the heating and cooling process. The manufacturing process is of course monitored. However, due to the difficulty in controlling the infiltration process in a mold having the complexity of a drill bit face, the most vigilant and careful processing cannot ensure the quality of every matrix.

The cost of premature failure of a drill bit can be substantial, especially in deep wells where the time and expense of pulling the drill string, replacing the bit, and returning the drill bit is a significant portion of the costs associated with drilling the well. Even a partial failure of the cutting surface of the bit slows drilling progress, causing the bit to wear sooner due to greater heating and necessitating more frequent replacement.

Unfortunately, due to the superhard nature of a matrix, it has been found that the quality of a matrix cannot be inspected by sampling the matrix material without destroying the matrix. Because the manufacturing process and materials are expensive, destroying a good drill bit for testing is costly and undesirable. Alternatively, a sample matrix made from batch materials may be heat treated with rotary drill bits made from the same batch. This reduces some of the expense of testing by destroying a finished bit. But both of these approaches are subject to sampling errors, i.e., the possibility that tested bits may not be representative of others in their batch. Neither approach allows for inspection of each matrix on each drill bit for conformance to the manufacturing process.

SUMMARY OF THE INVENTION

The invention is a method and an apparatus for inspection of the quality of a matrix without destroying the drill bit containing that matrix. The invention thus permits inspection of the matrix on every drill bit, ensuring a high level of quality that reduces the chance of premature failure of the drill bits in the field due to a poor quality matrix.

In a preferred embodiment, a cylindrical notch is formed in a nose portion of a bit casting mold. It is filled with matrix powder when the mold is loaded and infiltrated with binding alloy during normal manufacturing processes, forming a matrix extension. The extension is representative of the metallurgy of the entire matrix body. The matrix extension has a ratio of length versus diameter that allows for it to be removed without permanently damaging the face of the drill bit.

DETAILED DESCRIPTION OF THE PREFERRED EMBODIMENT OF THE INVENTION

The invention will be described, for purposes of illustration only, with reference to a matrix body, fixed cutter diamond bit such as that shown in U.S. Pat. Nos. 5,033,560 and 5,007,493, both of which are hereby incorporated herein by reference. It will be readily apparent to persons having ordinary skill in the art that the invention may be employed in connection with most matrix body rotary drill bits, without limitation to any particular cutter configuration, geometry or profile.

Figure 1:
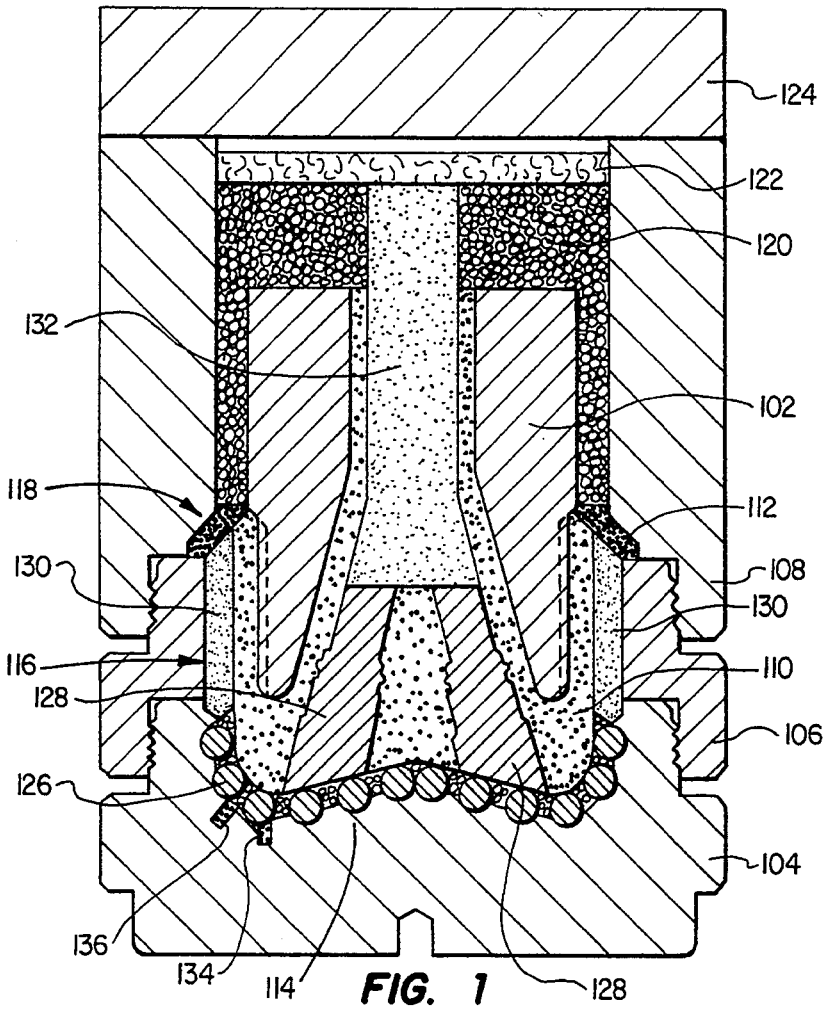
FIG. 1 is a cross-section of a mold for a matrix body, fixed cutter diamond bit.

Referring now to FIG. 1, there are several well-known types of molds 104 for casting a matrix body drill bit and techniques for making molds. Generally, they are divided into hard molds and soft molds. The molds may also be split or sectioned horizontally into multiple pieces. Hard molds are machined from a graphite blank to produce a negative of the profile of the cutting face of the bit. A soft mold is pressed with a machined graphite model of the bit head called a "master" or "pattern".

Once the mold is formed, its interior is assembled. If polycrystalline diamond (PCD) cutting elements are used, graphite inserts are placed in the mold as cutter displacements 126 create voids in which PCD cutters will be brazed to the matrix body after the matrix body is formed. If natural diamonds are used instead of PCD cutting elements, plot holes (not shown) are drilled into the mold along the bit face and diamonds deposited in them. Nozzle displacements 128 are put in place to create channels for drilling fluid, the channels having threaded receptacles for holding interchangeable nozzles. Sand displacements for "crowfeet" (not shown) are included with the natural diamonds. Sand displacements 130 are attached to the side of the mold to form "junk slots" on the sides of the drill bit. Finally, a sand core 132 is set on top of the nozzle displacements to provide a passage from the drill string through the drill bit for delivering drilling fluid to the nozzles.

A typical infiltration process for casting a matrix body drill bit begins by centering in mold 104 a head blank 102 made of ductile material that can be machined and threaded. A "gage" ring 106 is then threaded onto the top of the mold and a "funnel" ring 108 is screwed onto the top of the gage ring to extend the mold. "Hard" matrix powder 110 is loaded into the mold. The hard matrix powder, a blend of mostly tungsten carbide having the desired level of erosion resistance, impact strength and infiltrated density, is used on the drill bit face 114 and gage 116 of the bit. The term "hard" is used to distinguish this blend of tungsten carbide powder from a softer blend of matrix powder 112. Soft matrix powder is also predominantly composed of tungsten carbide. The soft matrix powder is subsequently loaded on top of the hard tungsten carbide powder at chamfer 118 between the gage and a shank (not shown) of the bit. "Soft" matrix powder forms a soft matrix that can be subsequently machined when an upper half of the drill bit, a shank and API connection, is attached to the matrix body.

As the mold is being filled with matrix powder, a series of vibration cycles are induced in the mold to assist packing of the powder and to help to ensure that the density of the matrix powder is consistent and within the range required to achieve the desired quality matrix.

A binder alloy 120 is placed on top of the tungsten carbide and topped with flux 122. A lid 124 covers the finished mold. The entire mold is first preheated and then placed in a furnace. When the furnace reaches the melting point of the binder alloy, the binder infiltrates the matrix powder. The casting is then removed and quenched at a controlled rate. Once cooled, the mold is broken away from the casting and the matrix body is subsequently processed according to well-known techniques to produce a finished drill bit.

This description of an infiltration process is intended only as an example of infiltration processes generally for casting matrix body drill bits.

Figure 2A:
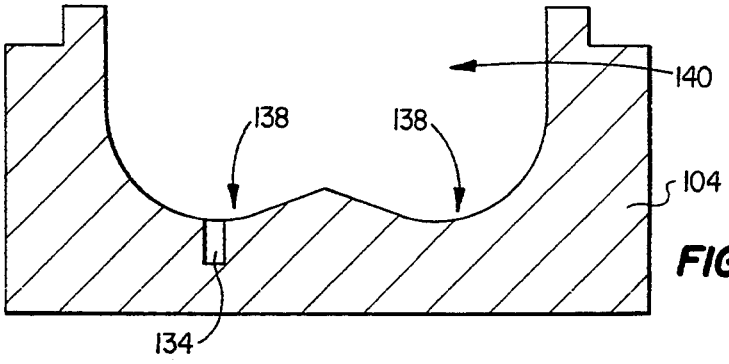
FIG. 2A is a cross-section of a schematically illustrated graphite mold for a matrix body fixed cutter bit showing one embodiment of the invention.
Figure 2B:
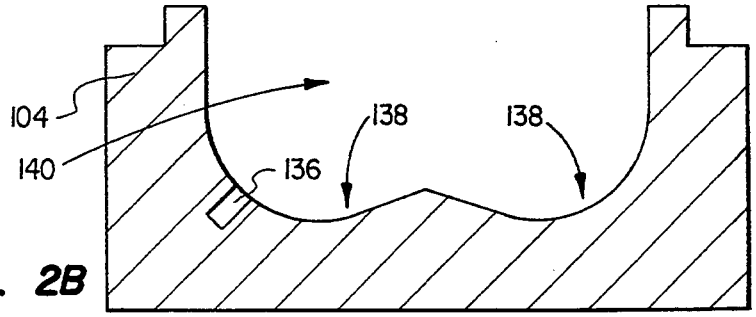
FIG. 2B is a cross-section of a schematically illustrated graphite mold showing a second embodiment of the invention.

Referring now to FIGS. 1, 2A and 2B, formed in nose portion 138 of the bit head depression 140 in the mold 104 are notches 134 and 136. Two notches are shown in FIGURE 1 only as examples of placement of a notch. Generally only one notch is used as shown in FIGS. 2A and 2B. If the mold 104 is a hard mold, the notches are machined in the depression during machining of the mold. If mold 104 is a soft mold, an extension is machined on the graphite master. The extension forms the notch when the master is pressed into the mold. Each notch is located in a position that does not interfere with placement of cutting elements or nozzles. The matrix extension is preferably formed on or as close to the nose of the drill bit as possible.

The notches are filled with hard matrix powder 110 during loading of the mold. The matrix powder is infiltrated during heating with binder alloy. The metallurgy of the matrix material in the matrix extension is thus representative of the metallurgy of the entire matrix body. The notches are cylindrically shaped and have a ratio of length (or depth) versus diameter sufficiently high to enable the extension of matrix material formed in them to be easily removed without causing permanent damage to the bit face. Preferably, the notch has a diameter of 0.25 inches and a length of 0.5 inches. The removed extension is then analyzed for its quality.

It is contemplated and will be apparent to those persons skilled in the art that variations and/or modifications of the preferred embodiment described and illustrated in the accompanying drawings may be made without departing from the invention. Accordingly, the spirit and scope of the invention is to be determined by reference to the appended claims.

What is claimed is:

1. In an infiltration method of producing a matrix body drill bit, an improvement comprising the steps of preparing a mold having a desired configuration and a small depression therein to receive a small amount of matrix material therein; adding the matrix material and an infiltrating alloy; and heating the mold to melt the infiltrating alloy to form a matrix body forming a small, removable extension of matrix material on the matrix body within said small depression.

2. The method of claim 1, wherein said extension has a length versus diameter ratio sufficient to allow said extension to be removed from the matrix body without causing damage to said body.

3. The method of claim 2, wherein said extension is a cylinder of matrix material substantially 0.25 inches in diameter and 0.5 inches in length.

4. The method of claim 2, wherein said matrix body is formed by an infiltration process in a graphite mold, and wherein said step of forming said small extension includes the step of forming a small depression in the graphite mold prior to infiltration.

5. The method of claim 4, wherein said graphite mold is a soft mold having the matrix body cavity formed therein by insertion of a bit pattern, and wherein said step of forming a small depression in the graphite mold includes the step of forming a small extension on the bit body pattern prior to insertion of said pattern into said mold.

6. The method of claim 5, wherein said extension is formed on the pattern during machining of the pattern.

7. The method of claim 4, wherein said mold is a hard graphite mold having the body cavity formed therein by machining and wherein said small sampling depression is formed therein by machining.

8. The method of claim 2, wherein said small extension is located near the nose of said body so as to be metallurgically representative of the entire matrix body.

9. A non-destructive method of sampling infiltrated matrix body of an oil well drill bit comprising the steps of:

preparing a mold having a desired configuration and a small depression therein;

forming a small extension of matrix material on said body within said small depression; and removing said extension from the matrix body for quality analysis of the matrix material.

10. The method of claim 9, wherein said step of removing occurs during the bit fabrication process when the matrix body is separated from the graphite mold.

11. The method of claim 9, wherein said extension has a length versus diameter ratio sufficient to allow said extension to be removed from the matrix body without causing damage to said body.

12. The method of claim 11, wherein said small extension is located near the nose of said body so as to be metallurgically representative of the entire matrix body.

13. The method of claim 11, wherein said extension is a cylinder of matrix material substantially 0.25 inches in diameter and 0.5 inches in length.

14. The method of claim 11, wherein said matrix body is formed by an infiltration process in a graphite mold, and wherein said step of forming said small extension includes the step of forming a small depression in the graphite mold prior to infiltration.

15. The method of claim 14, wherein said graphite mold is a soft mold having the matrix body cavity formed therein by insertion of a bit pattern, and wherein said step of forming a small depression in the graphite mold includes the step of forming a small extension on the bit body pattern prior to insertion of said pattern into said mold.

16. The method of claim 15, wherein said extension is formed on the pattern during the machining of the pattern.

17. The method of claim 14, wherein said mold is a hard graphite mold having the body cavity formed therein by machining and wherein said small sampling depression is formed therein by machining.

18. The method of claim 14, wherein the step of forming said small extension further includes the step of loading the small depression with matrix powder during the step of loading of the mold in the infiltration process.

* * * * *